US008552632B2

(12) United States Patent
Krusos et al.

(10) Patent No.: US 8,552,632 B2
(45) Date of Patent: Oct. 8, 2013

(54) ACTIVE MATRIX PHOSPHOR COLD CATHODE DISPLAY

(75) Inventors: Denis A. Krusos, Melville, NY (US); Anthony J. Campisi, Melville, NY (US)

(73) Assignee: Copytele, Inc., Melville, NY (US)

( * ) Notice: Subject to any disclaimer, the term of this patent is extended or adjusted under 35 U.S.C. 154(b) by 0 days.

(21) Appl. No.: 13/184,510

(22) Filed: Jul. 16, 2011

(65) Prior Publication Data

US 2011/0316411 A1 Dec. 29, 2011

Related U.S. Application Data

(63) Continuation-in-part of application No. 12/290,282, filed on Oct. 29, 2008, now Pat. No. 8,223,101, and a continuation-in-part of application No. 11/378,105, filed on Mar. 17, 2006, now Pat. No. 7,804,236, and a continuation-in-part of application No. 10/974,311, filed on Oct. 27, 2004, now Pat. No. 7,327,080, which is a continuation-in-part of application No. 10/782,580, filed on Feb. 19, 2004, now Pat. No. 7,274,136, which is a continuation-in-part of application No. 10/763,030, filed on Jan. 22, 2004, now abandoned, which is a continuation-in-part of application No. 10/102,472, filed on Mar. 20, 2002, now Pat. No. 7,129,626, application No. 13/184,510, which is a continuation-in-part of application No. 11/589,630, filed on Oct. 30, 2006, which is a continuation of application No. 10/102,472, filed on Mar. 20, 2002, now Pat. No. 7,129,626.

(60) Provisional application No. 61/000,958, filed on Oct. 30, 2007, provisional application No. 60/698,047, filed on Jul. 11, 2005, provisional application No. 60/715,191, filed on Sep. 8, 2005.

(51) Int. Cl.
*H01J 1/62* (2006.01)

(52) U.S. Cl.
USPC ..... 313/495; 313/497

(58) Field of Classification Search
USPC ..... 313/495–497, 306, 308–310, 351, 313/355, 292–294; 445/49–51; 257/167, 257/10–11; 315/169.1, 169.3; 345/74.1, 345/75.1, 75.2; 438/20; 427/77
See application file for complete search history.

(56) References Cited

U.S. PATENT DOCUMENTS

| | | | | |
|---|---|---|---|---|
| 4,046,666 | A * | 9/1977 | McClanahan et al. | 204/298.04 |
| 5,397,957 | A * | 3/1995 | Zimmerman | 313/309 |
| 5,663,611 | A * | 9/1997 | Seats et al. | 313/584 |
| 2001/0013755 | A1* | 8/2001 | Ogawa et al. | 313/496 |
| 2002/0074932 | A1* | 6/2002 | Bouchard et al. | 313/495 |
| 2002/0094494 | A1* | 7/2002 | Chung et al. | 430/311 |
| 2002/0113544 | A1* | 8/2002 | Lee et al. | 313/496 |

* cited by examiner

*Primary Examiner* — Anh Mai
*Assistant Examiner* — Fatima Farokhrooz
(74) *Attorney, Agent, or Firm* — Law Office of Carl Giordano, PC

(57) ABSTRACT

A flat panel display is disclosed. The flat panel display includes a plurality of electrically addressable pixels, a plurality of thin-film transistor driver circuits each been electrically coupled to an associated at least one of the pixels, respectively, a passivating layer on the thin-film transistor driver circuits and at least partially around the pixels, a conductive frame on the passivating layer, and a plurality of nanostructures on the conductive frame, wherein, creating a voltage difference between the pixels and the conductive frame by addressing one of the pixels using the associated driver circuit causes the nanostructures to emit electrons that induce a corresponding one of the pixels to emit light. The display further comprising a nano material deposited on a metal cathode layer. The nano-material providing additional electron emission through secondary electron emission.

21 Claims, 8 Drawing Sheets

ACTIVE MATRIX PHOSPHOR COLD CATHODE DISPLAY

CLAIM OF PRIORITY

This application claims, as a continuation-in-part, pursuant to 35 USC 120, priority to and the benefit of the earlier filing date of that patent application "Active Matrix Phosphor Cold Cathode Display," filed on Oct. 29, 2008, and afforded Ser. No. 12/290,282 (Copy-87NP) which claimed the benefit of the earlier filing date, under 35 USC 119(e), to provisional patent application Ser. No. 61/000,958, entitled "Active Matrix Phosphor Cold Cathode Display," filed on Oct. 30, 2007, the entire contents of each of which are hereby incorporated by reference herein (COPY-87-P2), and further claimed priority as a continuation-in-part of US application, entitled "Flat Panel Display Incorporating a Control Frame," filed on Mar. 17, 2006 and afforded Ser. No. 11/378,105, now U.S. Pat. No. 7,804,236, (COPY-77), which claims the benefit of the earlier filing date, under 35 USC 119(e) to provisional patent application Ser. Nos. 60/698, 047 filed on Jul. 11, 2005 and 60/715, 191, filed on Sep. 8, 2005, and further claims priority, as a continuation-in-part of U.S. patent application Ser. No. 10/974, 311, now U.S. Pat. No. 7,327,080, (Copy -74CIP2),entitled "Hybrid Active-Matrix Thin-Film Transistor Display," filed on Oct. 27, 2004, which is a continuation in part of U.S. patent application Ser. No. 10/782, 580, now U.S. Pat. No. 7,274,136, Copy-74CIP) entitled "Hybrid Active-Matrix Thin-Film Transistor Display," filed on Feb. 19, 2004, which is a continuation in part of U.S. patent application Ser. No. 10/763,030, now abandoned, (Copy-74) and entitled "Hybrid Active Matrix Thin-Film Transistor Display," file on Jan. 22, 2004, which is a continuation-in-part of U.S. patent application Ser. No. 10/102,472, now U.S. Pat. No. 7,129,626, (Copy-59), entitled "The Pixel Structure For An Edge Emitter Edge Field Emission Displays" filed on Mar. 20, 2002.

This application further claims, pursuant to 35 USC 120, priority to and the benefit of the earlier filing date of that patent application entitled Matrix Phosphor Cold Cathode Display Employing Secondary Emission, filed on Mar. 29, 2008 and afforded Ser. No. 12/079,658 (Copy-91), which claimed priority to that provisional patent application entitled "Passive Matrix Phosphor Based Cold Cathode Display", filed on Oct. 19, 2007, and afforded Ser. No. 60/999,783 and to provisional patent application entitled "Active Matrix Phosphor Cold Cathode Display", filed on Oct. 30, 2007 and afforded Ser. No. 61/000,958, the contents of all of which are incorporated by reference herein.

This application further claims, pursuant to 35 USC 120, as a continuation-in-part, priority to and the benefit of the earlier filing date of that patent application entitled "Pixel Structure for an Edge Emitter Field Emission Display." Filed on Oct. 10, 2006, and afforded Ser. No. 11/589,630, Copy-59CON), which claims priority as a continuation to that U.S. patent application Ser. No. 10/102,472, now U.S. Pat. No. 7,129, 626, (Copy-59), entitled "The Pixel Structure For An Edge Emitter Edge Field Emission Displays" filed on Mar. 20, 2002.

FIELD OF THE INVENTION

This application is generally related to the field of displays and more particularly to a flat-panel display (FPDs) using cold field emission sources and thin-film transistor (TFT) technology.

BACKGROUND OF THE INVENTION

Flat-panel display technology is one of the fastest growing display technologies in the world with a potential to surpass and replace Cathode Ray Tube (CRTs) in the foreseeable future as a result of this growth, a large variety of flat-panel displays exist which range from very small virtual-reality eye tools to large hang-on-the-wall television displays.

It is desirable to provide a display device that may be operated in a cold cathode field emission configuration, such as nanotubes, edge emitter, etc, and that exhibit a uniform, enhanced and adjustable brightness with good electric field isolation between pixels. Such a device would be particularly useful as a low-voltage flat-panel display incorporating a cold cathode electronic emission system, at pixel control system and phosphor-based pixels with or without memory and active devices such as transistors including those of the thin-film construction.

SUMMARY OF THE INVENTION

A flat panel display including a plurality of electrically addressable pixels, a plurality of thin-film transistor driver circuits each been electrically coupled to an associated at least one of the pixels, respectively, a passivating layer on the thin-film transistor driver circuits and at least partially around the pixels, a conductive frame on the passivating layer, and a plurality of nanostructures on the conductive frame, wherein, creating a voltage difference between the pixels and the conductive frame by addressing one of the pixels using the associated driver circuit causes the nanostructures to emit electrons that induce a corresponding one of the pixels to emit light.

In one aspect of the invention, nano-material is added to the cathode to increase electron emission. In another aspect of the invention, a polarity of the voltages applied to the conductive frame and the cathode layer may be altered to maintain an electron emission flow from the cathode layer.

BRIEF DESCRIPTION OF THE DRAWING

It is to be understood that the accompanying drawings are solely for the purposed of illustrating the concepts of the invention and are not drawn to scale. The embodiments shown in the accompanying drawings, and described in the accompanying detailed description, are to be used as illustrative embodiments and should not be construed as the only manner of practicing the invention. Also, the same reference numerals, possibly supplemented with reference characters, where appropriate, have been used to identify similar elements.

DETAILED DESCRIPTION OF THE INVENTION

Figure 1A:
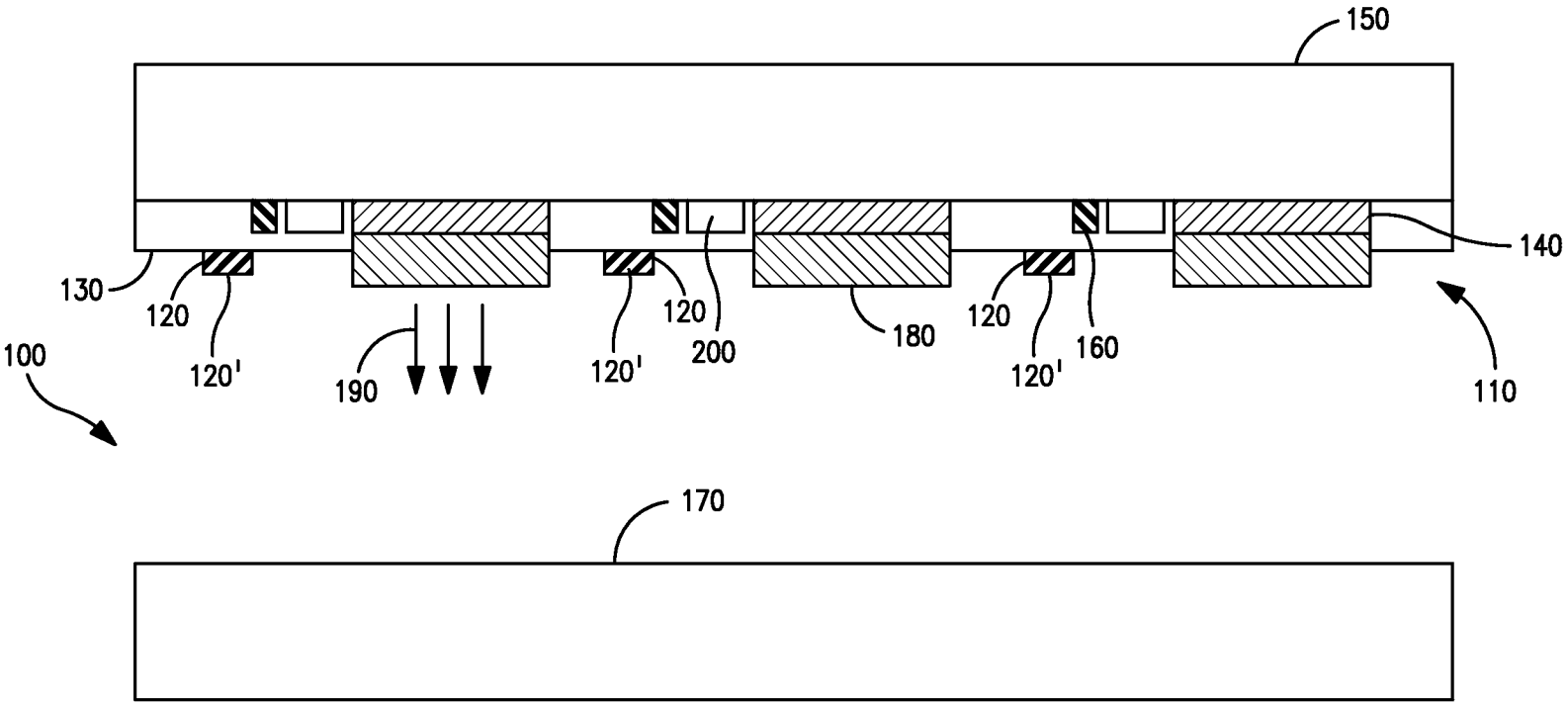
FIG. 1A illustrates an exemplary display device according to a first aspect of the present invention.

It is understood that the figures and descriptions of the present invention have been simplified to illustrate elements that are relevant for a clear understanding of the present invention while eliminating, for the purpose of clarity many other elements found in a typical flat-panel display system and methods of making and using the same. Those of ordinary skill in the art would recognize that other elements and/or steps are desirable and/or required in implementing the present invention. However because such elements and steps are well known in the art and because they would not facilitate a better understanding of the present invention a discussion of such elements and steps are not provided herein.

Before embarking on a more detailed description of the instant invention, it is noted that passive matrix displays and active-matrix displays all types of flat-panel displays that are used extensively as various displays devices, such as laptop and notebook computer displays for example. A passive matrix display utilizes a matrix or array of solid-state elements where each element or pixel is selected by applying a potential voltage to corresponding row and column lines that form the matrix. An active-matrix display further includes at least one transistor and capacitor that is also selected by applying a potential to corresponding row and column lines.

According to an embodiment of the present invention each pixel element includes a phosphor pad, which emits light of a known wavelength when stuck by an emitted electron, and an associated as TFT circuit. A thin-film transistor circuit (TFT) is a type of field effect transistor having thin films as metallic contacts, a semiconductor active layer and a dialectic layer. The thin-film transistors are widely used in liquid crystal display flat-panel displays. In one embodiment of the present invention each thin-film transistor circuit includes first and second active devices of electrically cascaded and capacitor in communication with output of the first device and an output of a second device that is used to selectively address pixel elements in the display. Various electron emission sources may be used with such a pixel and thin-film transistor circuit as will be described.

According to an embodiment of the present invention and control frame surrounds at least some of the pixels and associated TFT circuits in the array. In one configuration, the control frame surrounds each of the pixels and associated TFT circuits in the array. Such a control frame typically leads to improved display uniformity, brightness and electric field isolation between pixels regardless of the type of electron source used as compared to a comparable display not incorporating the control frame In one aspect of the invention, a noble gas, such as argon, and/or a mixtures of noble or ionizable gases, are injected in the space between the substrates.

Applying an appropriate voltage to the conductive layer (control frame) 120 creates a glow discharge that results in multiplication of the current produced by the cold cathode electron emitting source (nanotubes, edge emitters, tips, etc.) by ten or more orders of magnitude while the applied voltage is virtually constant. The glow discharge, referred to as the Townsend Discharge, is a gas ionization process wherein a small amount of free electrons accelerated by a sufficiently strong electric field give rise to electrical conduction through a gas by avalanche multiplication. When the number of free charges drops or the field weakens, the process stops. Townsend Discharge is named after John Sealy Townsend. Utilizing the Townsend Discharge and using the voltage on the conductive or control frame to accentuate the multiplication of the electron current emitted by the cold cathode increased the brightness of the display without an increase in the cold cathode voltage applied. Since the photons (light level) emitted by the phosphor is a linear function of the power then the brightness, at a constant voltage on the pixel is a linear function of the current. Since the current is increased by ten or more orders of magnitude then the brightness will increase at the same rate. The "sufficiently strong electric field" required for the Townsend discharge to occur is caused by the voltage applied to the conductive or control layer.

According to an aspect of the present invention, a pixel matrix control system having a control frame around each pixel associated with a thin-film transistor circuit of a display device is used to provide a display characterizes in having a good uniformity, an adjustable brightness and a good electric field isolation between pixels, regardless of the type of electron source used. For purposes of completeness, a TFT is a type of field effect transistor made by depositing thin films for the metallic contacts, semiconductor active layer and dielectric layer on a substrate.

In accordance with one aspect of the present invention, the diameter of a nanotube is typically on the order of a few nanometers. A single wall carbon nanotube or multiple wall carbon nanotubes may be utilized as cold cathode emitters.

According to an aspect of the present invention, the control frame includes a plurality of conductors arranged in a matrix having parallel horizontal conductors and parallel vertical conductors. Each pixel is bound by the intersection of vertical and horizontal conductors such at the conductors of the control frame surround the corresponding pixels to the right, left, top and bottom in a matrix fashion. The control frame may be fabricated of a metal including, for example, chrome, molybdenum, aluminum and/or combinations thereof.

According to another an aspect of the present invention, the control frame may be formed using standard lithographs, deposition and etching techniques.

In one exemplary configuration, conductors parallel to columns and rows are electrical connected together and a voltage is applied thereto. In another exemplary configuration, conductors parallel to columns are electrically connected together and have a voltage applied thereto. In another aspect, conductors parallel to the rows are also connected together, with a voltage applied thereto. In yet another exemplary configuration, a voltage is only applied to one of the parallel rows or parallel columns of conductors.

According to an aspect of the present invention, a vacuum flat-panel display incorporating a thin-film transistor circuit is disclosed. Associated with each pixel element is a TFT circuit that is used to selectively address the pixel element in the display. In one configuration, the TFT circuit includes first and second active devices electrically cascaded and a capacitor coupled to an output of the first device and input of the second device.

Referring now to FIG. 1A, there is shown a systematic cross-sectional view of a TFT emission display 100 according to a first exemplary embodiment of the invention.

Display 100 is composed of an assembly 110 that includes an anode that employs TFT circuitry to control the attraction of electrons and a control frame structure 120 deposited on passivation layer 130. In the illustrated display, control frame 120 is disposed on passivation layer 130 and surrounds each of the pixel elements 140/180. In one aspect of the invention control/conductive frame 120 supports electron emitting sources 120'. Emitter sources 120' may take the form of any electron emitter material having a suitably low work function. Source 120' may be a layer of electron emitting structures deposed upon conductive surface or layer 120. Suitable candidates for selection as electron emitters include layers having nano- and/or micro-structures, for example. Nanostructures may take the form of carbon nanotubes, for example. The nanotubes may take the form of single wall carbon nanotubes and/or multiple wall carbon nanotubes. The nanotubes of emitter layer 120' may be applied to substrate 120 using conventional methodologies, such as spraying, growth, electrophoresis or printing for example.

In the illustrated embodiment, the pixel metal layer 140 operates as the anode, which attracts electron emitted by the frame supported emitters 120', when a voltage differential exists between the metal layer 140 and emitter layer 120' on the control frame 120. Conductive pixel pads 140 may be composed of a transparent conductive material, such as ITO (Indium Titanium Oxide) or a nontransparent conductor, such as chrome, Moly Chrome (MoCr) or aluminum.

Conductive pixel pads 140 may be fabricated in a matrix of substantially parallel rows and columns on substrate 150 using conventional fabrication methods. Substrate 150 may be a transparent material, such as glass, or flexible material, e.g., a plastic. The substrate 150 may be selected as a material that does not create internal out-gassing during a sealing and vacuumization processing as is to be described. However, substrate 150 may also be made of a material that is opaque.

Substrate 170, which serves to confine the FPD housing in an evacuated environment may also be made of a transparent (or at least translucent) material, such as glass or other flexible material but alternatively may be opaque. Additionally, pixel pad metal layer 140 may be composed of a transparent conductive material, such as ITO (Indium Titanium Oxide) or a non-transparent conductive such as Chrome (CR), Moly Chrome (MoCr) or aluminum.

Deposited on each conductive pixel pad 140 is phosphor layer 180. Each phosphor layer 180 is selected from materials that emit light 190 of a specific color, wavelength, or range of wavelengths. In a conventional RGB display, phosphor layer 180 is selected from materials that produce one of a red light, green light and blue light when struck by electrons. In the illustrated embodiment, light (i.e. photons) 190 is emitted in the direction of substrate 170 for viewing. If the pixel metal 140 is of a transparent (or translucent) material (such as ITO) rather than an opaque material, light emissions 190 emitted by phosphor layer 180 may be transmitted in the directions of both substrate 150 and 170. Otherwise, when the pixel metal 140 is reflective, the light emitted by phosphor layer 190 is re-directed to substrate 170 by reflective pixel metal layer 140.

Incorporated on substrate 150 are conductive pixel column and row addressing lines associated with each of the corresponding conductive pixel pads 140. The pixel row and column addressing lines may be substantially perpendicular to one another. Such a matrix organization of conductive pixel pads 140 and phosphor layers 180 allows for X-Y addressing of each of the individual pixel elements 140 in the display, as will be understood by those possessing an ordinary skill in the pertinent arts.

Incorporated onto substrate 150 also are TFT circuit 200 which are connected to corresponding pixels through defined by their relationship to pixel column and row addressing lines associated with each of the corresponding conductive pixel pads 140.

TFT circuit 200 operates to apply an operating voltage to the associated conductive pixel pad 140/phosphors layer 180 pixel element through the pixel column and row addressing matrix. TFT circuit 200 operates to apply either a first voltage to bias an associated pixel element to maintain it in an "off" state or a second voltage to bias the associated pixel element to maintain it in an "on" state or any immediate state. In this illustrated case conduction by a pixel pad 140 is inhibited from attracting electrons when the TFT circuit maintains the pixel element in an "off" state, and enables the pixel element to attract electrons went in an "on" state or any intermediate state.

Thus, TFT circuitry 200 in biasing conductive pixel paid 140 provides for the dual functions of addressing pixel elements and maintaining the pixel elements in a condition to attract electrons for a desired time period, i.e., timeframe or sub- periods of time frame.

The anode (pixel) voltage ($V_{pixel}$) of each pixel determines the brightness or color intensity of that pixel. By positively biasing the pixel voltage ($V_{pixel}$) relative to the voltage of the frame 120, then electrons may then be attracted to the positively biased pixel pad 140. The electrons, which strike phosphor 180, cause the phosphor 180 to emit light 190. The wavelength of the emitted light depends upon the selected phosphor, as previously described. The electron flow to the anode (i.e., pixel current) is a function of the pixel voltage, thereby predicting an illumination that is proportional to the amplitude of column data, which is proportional to the amplitude of the image data.

Although not shown, it would be recognized that the substrates 150 and 170 may be sealed at their edges to provide an enclosed space (a hollow) that may contain a vacuum that allows for a reduction in the voltage difference between a voltage on anode (pixel pad metal layer 140) and control/conductive frame 120. In addition, the enclosed space between substrates 150 and 170 may be filled with a low-pressure gas.

In one aspect of the invention, a noble gas, such as argon, and/or mixtures of noble or ionizable gases, are injected in the sealed space between the substrates 150, 170. In this case, applying an appropriate voltage to conductive layer (control frame) 120 a glow discharge is created that results in multiplication of the current produced by the cold cathode electron emitting source (nanotubes, edge emitters, tips, etc.) by ten or more orders of magnitude while the applied voltage is virtually constant. The glow discharge, referred to as the Townsend Discharge, is a gas ionization process wherein a small amount of free electrons accelerated by a sufficiently strong electric field give rise to electrical conduction through a gas by avalanche multiplication. When the number of free charges drops or the field weakens, the process stops. Townsend Discharge is named after John Sealy Townsend.

Accordingly, utilizing the Townsend Discharge and using the voltage on the conductive or control frame to accentuate the multiplication of the electron current emitted by the cold cathode the brightness of the display increases without an increase in the applied voltages to the cold cathode and the anode. Since the photons (light level) 190 emitted by the phosphor 180 is a linear function of the power then the brightness, at a constant voltage on the pixel is a linear function of the current. Since the current is increased by ten or more orders of magnitude then the brightness will increase at the same rate. The "sufficiently strong electric field" required for the Townsend discharge to occur is caused by the voltage applied to the conductive or control layer 120.

Figure 1B:
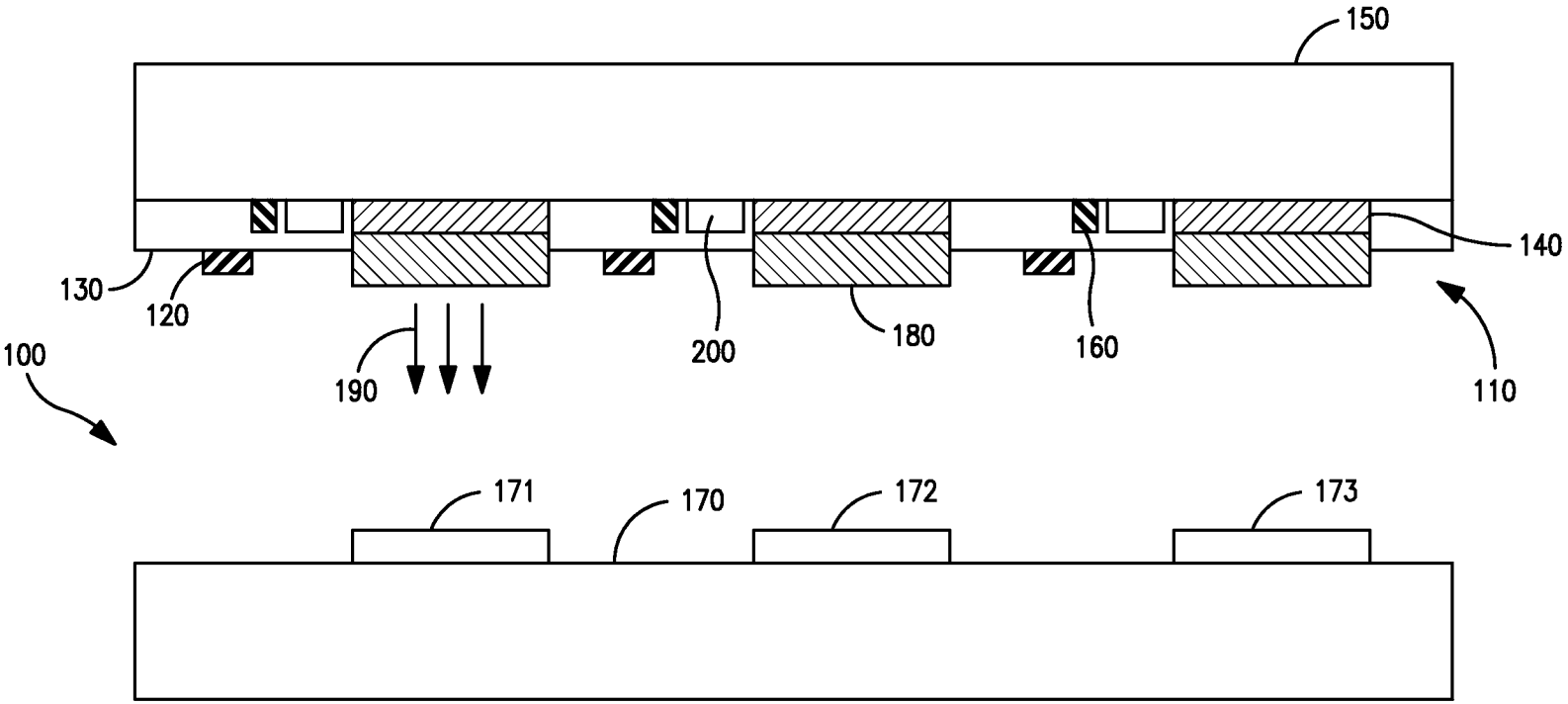
FIG. 1B illustrates an exemplary display device according to a second aspect of the present invention.

Referring now to FIG. 1B, there is shown a systematic cross-sectional view of a TFT and cold cathode field emission display 100 according to a second exemplary embodiment of the invention. In this exemplary embodiment, which is similar to that shown in FIG. 1A, discloses a metal layer configured as metal stripes 171, 172, 173 deposited on substrate 170. The metal layer stripes 171, 172, 173 are separated from one another as shown and configured relative to assembly 119. The ML layer 171, 172, 173 is preferable transparent and may be fabricated from an ITO or other similar metal. Although the ML is shown as stripes 171, 172, 173 it would be recognized that the metal layer (ML) 171, 172, 173 may comprise a single uniform layer that extents substantially over the entire surface of substrate 170. The metal layer (ML) is advantageous as a voltage, from a conventional power or voltage source, applied to the ML may be used to ionize a gas contained within the space between substrates 150 and 170. Ionization of a low pressure noble gas, as previously described, serves to increase the brightness caused by the electron emission.

Figure 2A:
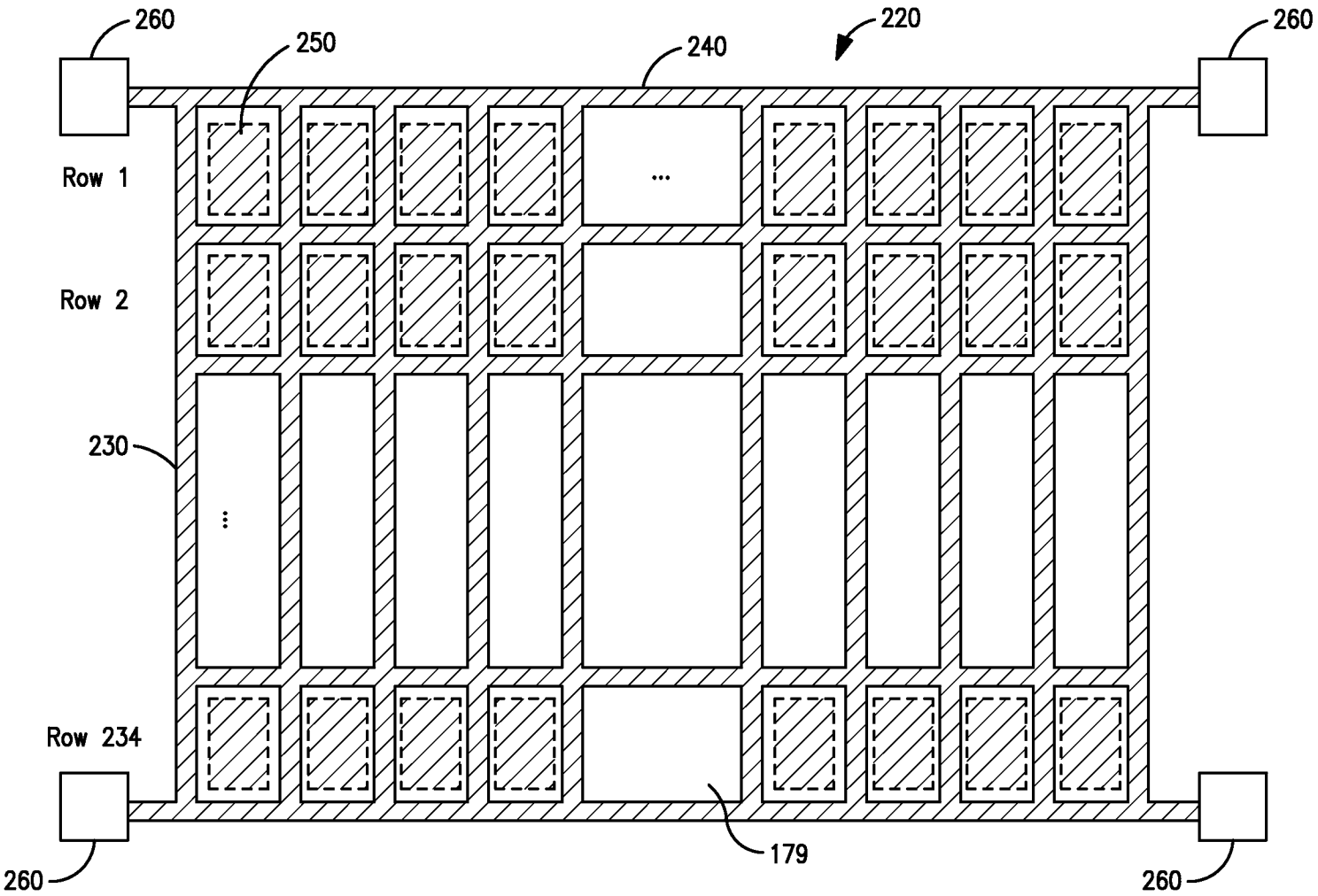
FIG. 2A illustrates a plan view of a control frame around each pixel and having a fixed voltage according to an aspect of the present invention.

FIG. 2A illustrates a plain view of an exemplary control frame 220 suitable for use as control frame 120 of FIG. 1A/1B. Control frame 220 includes a plurality of conductors arranged in a rectangular matrix adding parallel vertical conduct of lines 230 and parallel horizontal conductive winds 240, respectively. Each pixel 250 (e.g. pad 140 and phosphor 180 FIG. 1) is bounded by vertical and horizontal conductors or lines 230, 240 such at the conductor substantially surround each pixel 250 to the right, left, top, and bottom. One or more conductive pads 260 electrically connect conductive frame 220 to a conventional power source or voltage source (not shown). In the illustrated embodiment of FIG. 2A, four conductive pads 260 are coupled to the conductive lines 230, 240 of frame 220. In an exemplary embodiment, each pad 260 is in the order of 100×200 micrometers (microns) in size.

Figure 2B:
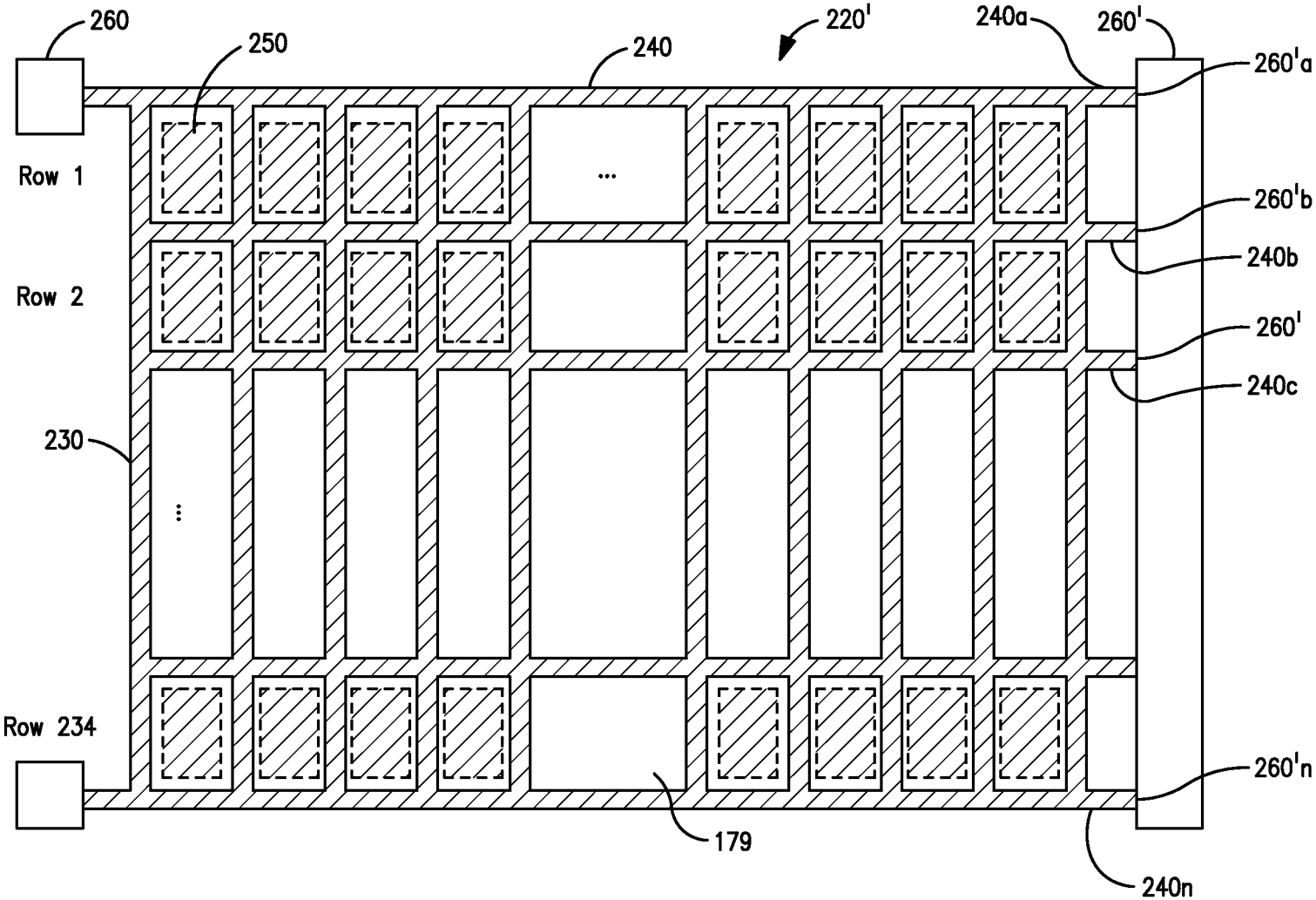
FIG. 2B illustrates a plan view of a control frame according to another aspect of the present invention.

FIG. 2B shows another exemplary configuration of the control frame structure similar to that of FIG. 2A (wherein like reference numerals are used to indicate like parts), but wherein two of the pads 260 of FIG. 2A are replaced by a single conductive bar or bus 260'. The conductive bar 260' is coupled to each of the parallel horizontal conductive lines $\mathbf{240}_a$, 240*b*, $\mathbf{240}_c$ . . . $\mathbf{240}_n$ at corresponding positions $\mathbf{260}_a$, 260*b*, $\mathbf{260}_c$ . . . $\mathbf{260}_n$ along the bar. In the illustrated configuration, the row lines are substantially identical to one another and interconnect to the bar at uniform spaces along the length of the bar. This configuration provides for an equipotential frame configuration with minimum voltage drops as a function of frame position.

In the illustrated embodiment control frame 220 (or 220') is formed as a metal layer above the final passivation layer shown in as element 130, in FIG. 1). Pads 260 and metal lines provide that the control frame structure 220 remains free from past passivation in the illustrated embodiment. In an exemplary configuration, the control frame metal layer has a thickness of less than about 1 micron (μm), and a width of the order about 16-19 microns, although other thicknesses and widths may be used to depending on particular design criteria.

Figure 4:
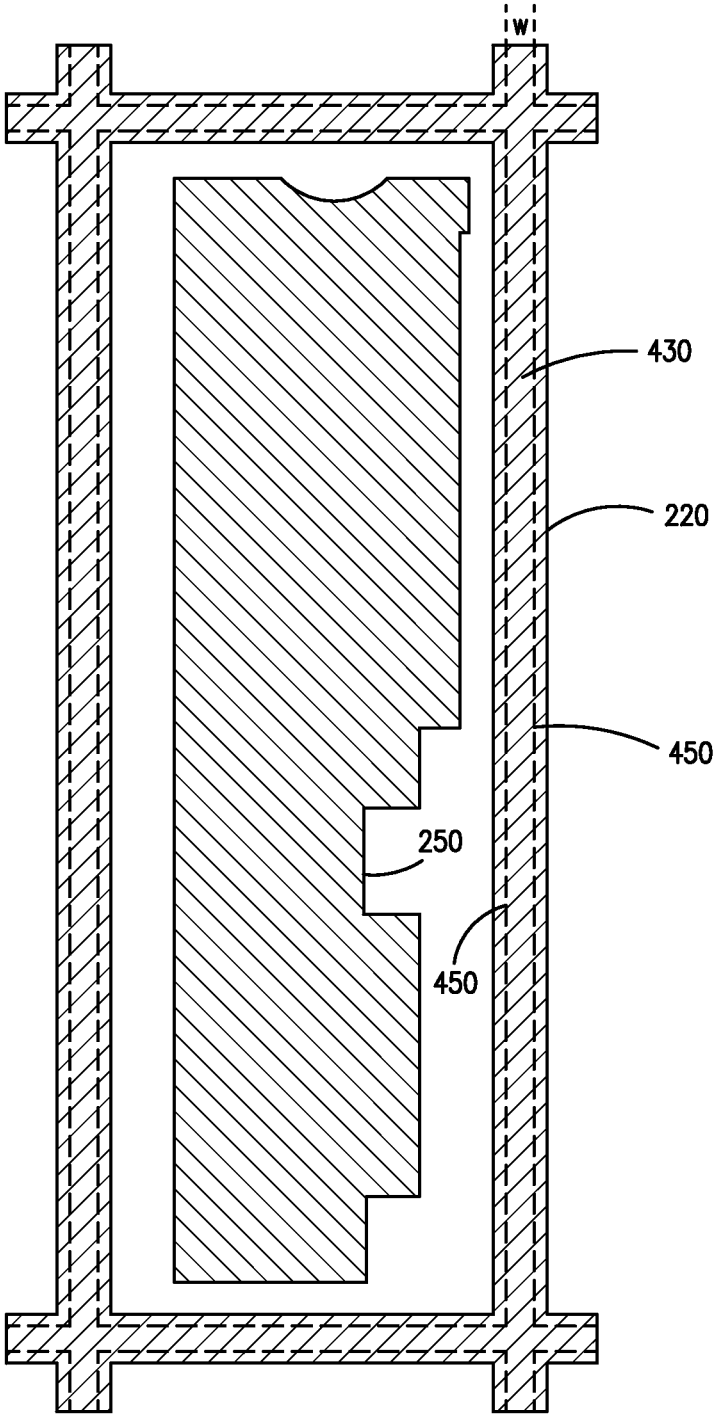
FIG. 4 illustrates a top view of a control frame according to another aspect of the present invention.

Referring to FIG. 4, the conductive part of the frame 220 may be widened (e.g. by about 4 μm) and an insulating 450 (e.g., SIN) provided at each edge for preventing electrical short-circuits from a frame to the pixels, and to encapsulate the frame edge which is associated with high field density. Accordingly, the exposed part 430 of the frame may have a width w of about 12 to 15 μm.

According to an aspect of the present invention, nanostructures are provided upon control frame 220. The nanostructures may take the form of SWNTs or MWNTs. The nanostructures they take the form of carbon nanotubes, for example. The nanostructures may be applied to the control frame using any conventional methodology such as spraying, growth, electrophoresis, or printing, for example.

By way of further non-limiting example only, were electrophoresis is used to apply nanotubes to frame 220, about 5 mg of commercially available carbon nanotubes may be suspended in a mixture of about 15 mL of Toluene and about 0.1 mL of a surfactant, such as polyisobutene succinamide (OLOA 1200). The suspension may be shaken in the container beads for about 3-4 hours. Thereafter, the frame may be immersed in the shaken suspension, while applying a DC voltage to the frame that is negative relative to suspension electrode (where the nanotubes have a positive charge).

Returning to FIG. 2A/2B, while the vertical conductors 230 and horizontal conductors 240 frame each pixel 250 above the plane of the pixels 250 in the illustrated embodiment (see, e.g. FIG. 1) other configurations are contemplated. For example, the conductors may be disposed in the same plane as that of the pixels. Further yet, conductors 230, 240 may be connected in a number of configurations. For example, in one configuration, all horizontal and vertical conductors are joined together are shown in FIG. 2A, for example, and a voltage is applied to the entire control frame configuration.

In another configuration, all horizontal conductors 240 are joined and separately all vertical conduct is 230 are joined. In this connection configuration the horizontal conductors 240 and vertical conduct is 230 are not electrically interconnected. Thus, a voltage may be applied to a horizontal conductor array, and a separate voltage may be applied to the vertical conductor array. Other configurations are also contemplated, including for example, a configuration of all horizontal conductors only, or a configuration of all vertical conductors only. For example the control frame 120 (FIG. 1) may include only metal lines parallel to the columns or only metal lines parallel to the rows.

Regardless of the particular configuration, a voltage ($V_{TN}$), equal to ($V_{PIXEL(Low)}$−($V_{TN}$)) may be applied to the frame via pads 260, where ($V_{TN}$) represents the nanostructures emitting threshold and $V_{PIXEL}(_{Low})$ represents the minimum pixel voltage. This voltage may serve to keep the frame supported nanostructures to just below the emitting threshold when the pixel voltage is in its "OFF" state. This permits the pixel voltage to transition from its "OFF" state to the "ON" state and all voltages in between to cause changes in brightness (Gray Scale).

The anode (pixel) voltage $V_{PIXEL}$ of each pixel determines the brightness or color intensity of that pixel. By positively biasing the pixel voltage $V_{PIXEL}$ relative the voltage of the frame, the voltage on that pixel increased beyond the emitting threshold of the nanotubes ($V_{THN}$), such at the frame supported nanostructures in the region around the biased pixel are caused to emit electrons, which are then attracted to the positively biased pixel. In other words, when the voltage applied to the pixel ($V_{PIXEL}$) relative to voltage applied to the control frame nanostructures ($V_{TN}$), exceeds the emission threshold ($V_{THN}$), electrons are emitted from the nanostructures. The electrons emitted from the nanostructures move to the anode (pixel pad 140/phosphor 180), thereby causing the phosphor 180 to emit light, $V_{PIXEL}>=V_{TN}+V_{THN}$. The wavelength of the emitted light depends upon the phosphor. The electron flow to the anode (i.e. pixel current) is a function of the pixel voltage, thereby producing an illumination which is proportional to the amplitude of the column data, when the voltage signal applied to the pixel is proportional to the amplitude of the data.

Figure 3:
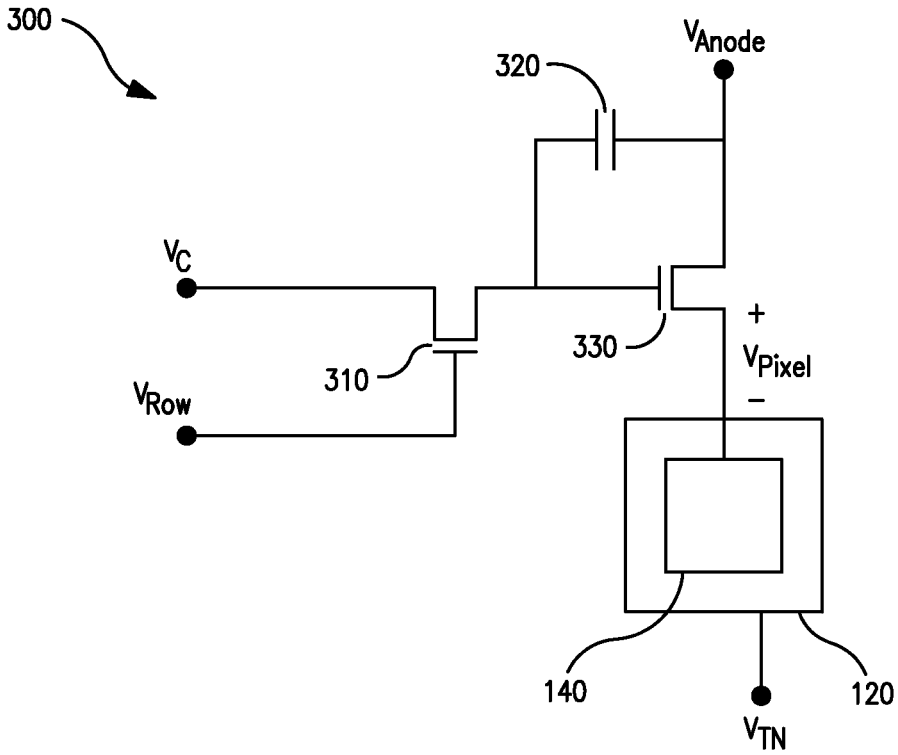
FIG. 3 illustrates a circuit for driving the pixels of FIGS. 1A/1B according to an aspect of the present invention.

According to an aspect of the present invention, control of one or more of the TFTs associated with the display device can may be accomplished using the circuit 300 of FIG. 3. Circuit 300 includes first and second transistors 310, 330 and capacitor 320 electrically interconnected with pixel, e.g. pixel 140, FIG. 1.

In general, the voltage used to select the row ($V_{ROW}$) is equal to the fully "on" voltage of the column ($V_C$). The row voltage in this case causes the pass transistor 310 to conduct. The resistance of pass transistor 310, capacitor 320 and the write time of each selected pixel row determines the voltage at the gate of transistor 330, as compared to $V_C$. Using a voltage $V_{ROW}$ higher than the fully "on" voltage ($V_C$) increases the conduction of transistor 310, reducing its resistance and resulting in an increase in pixel voltage ($V_{PIXEL}$) and enhance brightness. Thus, in one aspect, the selection voltage for the row is higher than the highest column voltage, thereby causing transistor 310 to turn on heavily, thereby reducing the associated resistance of providing a greater voltage on the gate of transistor 330. VANODE is the power supply voltage, and may be of the order of about 40V. In such a configuration $V_{PIXEL(Low)}$ may be on the order of around 6-12 V.

Figure 5:
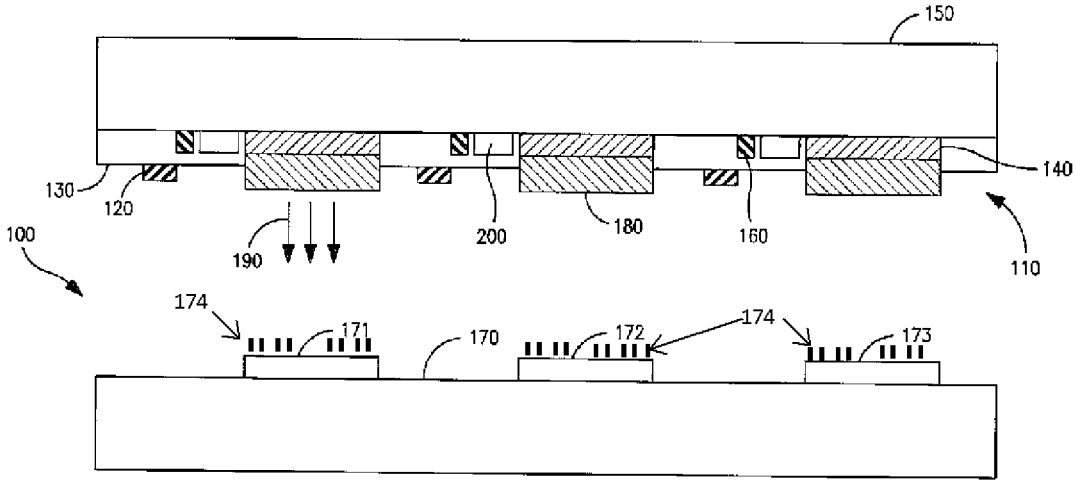
FIG. 5 illustrates a side view of an exemplary display in accordance with an aspect of the present invention.

FIG. 5 illustrates an exemplary embodiment of another aspect of the invention, wherein nanomaterial 174 is added to the ML layer 171, 172, 173. As the elements shown in FIG. 5 are similar to, or the same as, those shown in FIG. 1A, for example, a description of these similar or same elements is not repeated with regard to FIG. 5.

In this illustrated aspect of the invention, nanomaterial 174 deposited on the ML layer 171, for example, may be selected from materials such as Carbon nanotubes , Magnesium Oxide (MgO), Graphene, Silicon DiOxide ($SiO_2$), which are materials known to have good electron emission properties.

As previously described, an ionize gas may be created when electrons from the conductive frame 120, impact atoms of the noble gas. That is, as the voltage difference between the conductive frame 120 and the pixel exceeds a threshold voltage, electrons emitted from the conductive frame impact atoms of the noble gas as the electrons proceed from the conductive frame 120 to the pixel 140. The impact causes electrons to be released from the noble gas atoms resulting in additional electron emission from the nobel gas atoms and creating a positively charged ion of the noble gas atom. The positively charged ions may then be drawn to the ML layer, wherein additional electrons may be released, The addition of nanomaterial 174 on the ML layer is advantageous as it provides for increased secondary electron emission flow after a plasma (i.e., an ionized gas) is formed by an initial electron flow between the conductive frame and the anode.

In addition, as the nanomaterial on the ML layer provides the majority of the electron flow after the initial plasma has been established, the size of the conductive frame may be reduced as the need of significant nanomaterial on the conductive frame is reduced. Hence, the distance between pixels may be reduced as the size of the conductive frame is reduced.

In addition, in one aspect of the invention, after an initial plasma has been created from electron emission from the conductive frame and secondary emission from the nano material 174 occurs, the voltage applied to the conductive frame may be removed or changed in polarity. In this case, electron emission continues from the emission from the nano material 174. In one aspect of the invention, a negative voltage (with respect to the pixel voltage) may be applied to the ML layer 171, 172, 173. In this case, the negatively charged ML layer provides assistance in drawing electrons from the conductive layer 120 and also drawing positively charged ions to the ML layer 171, 172, 173, wherein an impact of the positively charged ion with the nanomaterial on the ML layer increases the electron emission (i.e., secondary emission).

Figure 6:
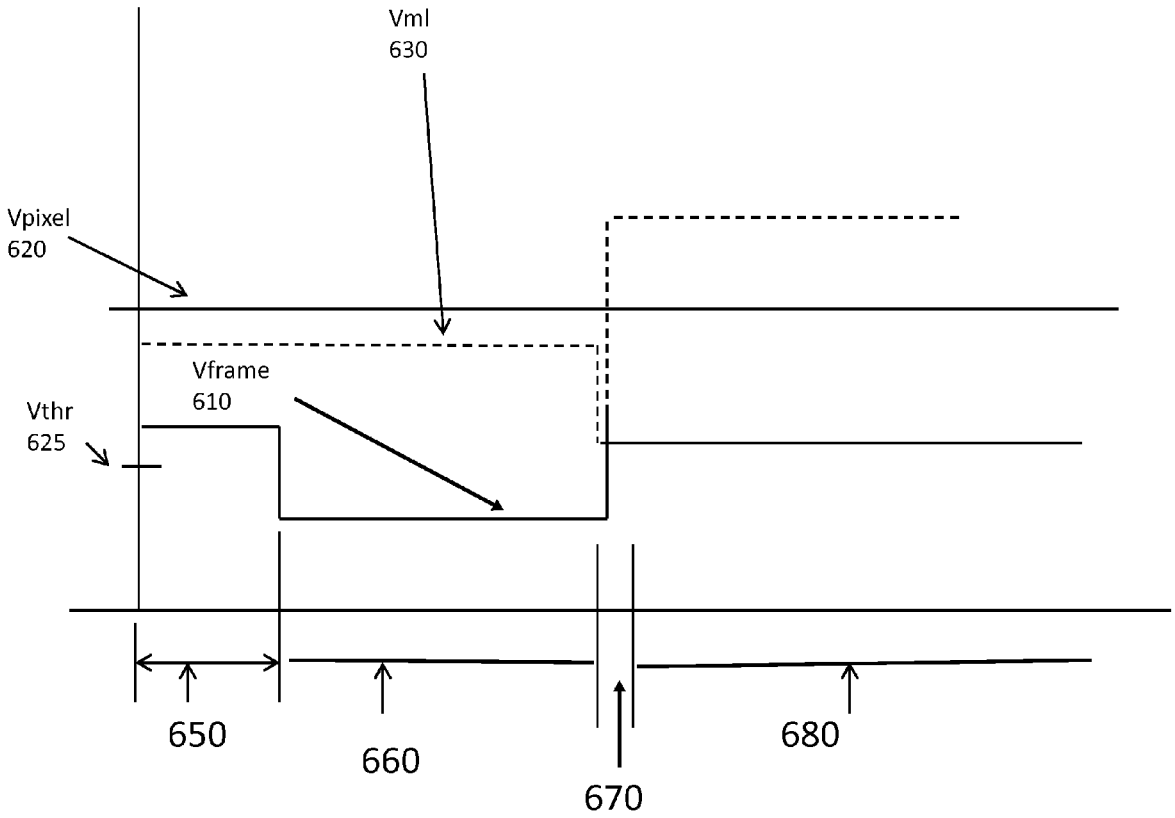
FIG. 6 illustrates a graph of an application of voltages to the exemplary display shown in FIG. 5.

FIG. 6 illustrates a graph of an exemplary application of voltage to the pixel pad 140,(i.e., Vpixel), conductive frame 120 (i.e., Vframe) and the ML layer 171, 172, 173 (Vml). In this exemplary case, the voltage (610) applied to the conductive frame is initially negative with respect to the voltage (620) applied to the pixel pad 140. As previously discussed, the voltage (610) on the conductive frame may be held slightly below a voltage necessary for electron emission from the conductive frame when no activity is required (period 650). That is, the difference in the voltage applied to the pixel pad and the voltage applied to the frame is less than a threshold value (i.e., Vthr) 625.

When an image is to be presented on the display and electron emission is required from a corresponding pixel, an additional voltage may be applied to the conductive frame 120 so that a difference in voltage between the pixel pad 140 and the conductive frame 120 exceeds threshold voltage (625) and electron emission from the conductive frame to the pixel pad is initiated. (period 660). That is, the conductive frame is excited by the additionally applied voltage to emit electrons. As electronic emission begins, the gas within the display cavity or hollow begins to ionize as previously described, wherein electrons drawn from the conductive frame strike or collide with atoms of the noble gas, causing an electron to be released from the noble gas atom and leaving the noble gas atom as a positively charged noble gas ion.

During periods 650, 660, a voltage (630), which may be optionally, applied to ML layer 171, for example, may be held at a level such that a voltage difference between the ML layer and the pixel pad 140 may be a zero value or a negative value. The voltage Vml 630 is represented as a dashed line during this period(s) as this value may be selected based on power requirements or response time. A negative voltage difference between the ML layer 171 and the pixel pad 140 may be advantageous as it provides assistance in directing electrons extracted from the conductive frame 120 toward the gas atoms in the cavity.

After electronic flow from the conductive frame 120 begins and an ionization of the enclosed gas occurs, the voltage (610) applied to conductive frame may be removed or set to a positive value with respect to the voltage (620) applied to the pixel pad 140(period 670). In this case, the voltage applied to conductive frame 120, may be returned to its initial value, or to a value comparable to that on the pixel pad 140, or a more positive value or removed entirely.

As illustrated in FIG. 6, prior to switching or removing the voltage applied to the conductive frame 120, the voltage (630) applied to ML layer 171, may be set further negative with respect to the voltage (620) applied to pixel pad 140 (period 670). In this case, the voltage on the ML layer 171, for example, may be altered to increase the drawing of positively charged noble gas ions to the ML layer. That is, the difference in voltage between the ML layer and the pixel pad 140 is sufficient to draw the ionized noble gas to the ML layer. The voltage is set so as to sustain secondary electron emission from the nanomaterial on the ML layer as the ionized noble gas impacts the nanomaterial. The voltage applied to the ML layer 171 is maintained for the remainder of the display frame period (period 680). In one aspect of the invention, the voltage on the ML layer may be set so that the voltage difference between the pixel pad 140 and the ML layer 171, for example, may be set to draw ionized noble gas atoms to the ML layer. In another aspect of the invention, the voltage difference between the pixel pad 140 and the ML layer 171, for example, may be sufficiently high to cause electron emission from the nano material. In one aspect of the invention, the difference in voltage between the ML layer and the pixel pad 140 may be in the order of twenty (20)-one hundred (100) volts. Preferably, the difference in voltage between the ML layer and the pixel pad 140 is in the order of forty (40)-sixty (60) volts.

In one aspect of the invention, ionization is deemed to occur after a predetermined period of time after the application of a voltage to conductive frame that caused electrons to be emitted from the conductive frame. Hence, the switching of the applied voltages may be initiated after the predetermined time (period 670). In one aspect of the invention, the predetermined time may be determined based on factors such as the size of the cavity (hollow) formed between the first and second substrates, the type of gas and the applied voltages.

Although period 670 is shown to begin and end before and after the transition of the ML layer and conductive frame voltages, it would be understood that the illustrated period 670 is not drawn to scale and that the period would begin with the beginning of a transition of the voltage associated with one of the ML layer and conductive frame. In addition, the transition period may end when the voltages on the ML layer and the conductive frame is substantially equal to their final voltage levels (for example, within 10 percent of the final voltage level).

Although not shown in the drawings, a switchable voltage source or multiple voltage sources may provide the appropriate voltages to the conductive frame 120, pixel pad 140 and ML layer 171, 172, 173, in accordance with the exemplary voltage profile shown in FIG. 6. Such switchable voltage source or multiple voltage sources may be controlled by a controlling unit (e.g., a processing system, a processor, a computer, FPGA, ASIC, etc.) that controls the application of the voltages to the conductive frame 120, pixel pad 140 and ML layer 171, 172, 173, at the appropriate time.

While there has been shown described and pointed out fundamentally novelty to the present invention as applied to preferred embodiments thereof, it will be understood that various omissions and substitutions and changes in the apparatus described in the form and details of the devices disclosed and in their operation may be made by those skilled in the art without departing from the spirit of the present invention. For example the control frame described previously may be used with any display which uses electrons or charged particles to form an image, such as an LVND, Electrophoretic, or VFD display. As discussed above, it is also understood that the present invention may be applied to flexible displays in order to form an image thereon.

It is especially intended that all combinations of those elements that perform substantially the same function in substantially the same way to achieve the same result are within the scope of the invention. Substitution of elements from one described embodiment to another are also fully intended and contemplated.

While there has been shown, describe and pointed out fundamental novel features of the present invention as applied to preferred embodiments thereof, it will be understood that various omissions and substitutions and changes in the apparatus described in the form and details of the devices disclosed, and in their operation, may be made by those skilled in the art without departing from the spirit of the present invention. For example, the control frame described previously may be used with any display that uses electrons or charged particles to form an image. As discussed above, it is also understood that the present invention any be applied to flexible displays in order to form an image thereon.

What is claimed is:

1. A flat panel display comprising:

a first substrate and an opposing second substrate, sealed about their periphery to form a cavity therebetween, said hollow being filled with a noble gas;

the first substrate, including a plurality of electrically addressable pixels, each of said pixels comprising: a conductive pad, and a phosphor material deposited on a corresponding conductive pad;

a plurality of thin-film transistor (TFT) driver circuits each being electrically coupled to an associated one of said plurality of pixels;

a passivating layer on said thin-film transistor driver circuits and at least partially around said plurality of pixels;

a conductive frame on said passivating layer; and, a plurality of cold cathode emitters located on the conductive frame; and the second substrate comprising:

a metal layer corresponding to each of said plurality of pixels; and a nano material deposited on the metal layer; and a controlling device configured to:

control a switching voltage that applies a voltage to each of the plurality of pixels, the conductive frame and the metal layer, wherein the voltage applied to the metal layer is applied a predetermined time after applying the voltage to the conductive frame, said predetermined time being determined based on a time to ionize said noble gas, wherein said voltages applied to the conductive frame and the metal layer being negative with respect to the voltage applied to the pixel.

2. The display of claim 1, wherein the nano material is selected from the group consisting of: carbon nanotubes, MgO, graphene and $SiO_2$.

3. The display of claim 1 wherein the voltage applied to the conductive frame is set to inhibit electron emission from the cold cathode after the predetermined time.

4. The display of claim 1, wherein said electrically addressable pixels are coated with a phosphor.

5. The display of claim 1, wherein said first substrate is transparent.

6. The display of claim 1, wherein said conductive frame comprises a plurality of parallel rows of conductors.

7. The display of claim 1, wherein said conductive frame comprises a plurality of parallel columns of conductors.

8. The display of claim 1, wherein said conductive frame comprises a matrix of row and column conductors defining a plurality of cells, each cell being associated with one of said pixels.

9. The display of claim 1, wherein said cold cathode emitters comprise carbon nanotubes.

10. The display of claim 1, further comprising:

means for ionizing said noble gas.

11. The display of claim 1, wherein said driver circuit comprises a first transistor coupled to said conductive pad, and a second transistor and capacitor coupled to a gate of said first transistor.

12. A display comprising:

a first substrate;

a plurality of electrically addressable pixels supported on said first substrate, each of said pixels comprising a conductive pad, and a phosphor material deposited on a corresponding conductive pad;

a conductive frame supported on said first substrate; and a plurality of cold cathode emitters positioned on said conductive frame;

a second substrate positioned opposite from said first substrate, wherein said second substrate is transparent and said first and second substrates being sealed at their peripheries to create a cavity therebetween, said cavity being filled with a noble gas; and said second substrate including:

a metal layer (ML) corresponding to one of said addressable pixels; and nanomaterial deposited on the metal layer;

means for addressing one of said pixels to cause said cold cathode emitters to emit electrons; and a switching voltage source:

applying a voltage to said conductive frame to emit electrons from said cold cathodes positioned on said conductive frame for at least a predetermined time; and switching a voltage applied to the ML layer from a first value to a second value a predetermined time after applying said voltage to said conductive frame, said predetermined time being determined based on a time to ionize said noble gas, wherein the second value being negative with respect to the voltage applied to a corresponding pixel.

13. The display of claim 12, wherein said first substrate is transparent.

14. The display of claim 12, wherein said conductive frame comprises a matrix of row and column conductors defining a plurality of cells, each cell being associated with one of said pixels.

15. The display of claim 12, further comprising at least one contact pad electrically coupled to said conductive frame.

16. The display of claim 12, wherein said cold cathode emitters comprise carbon nanotubes.

17. The display of claim 12, wherein each of said pixels comprises a conductive pad and at least one transistor coupled to said conductive pad.

18. The display of claim 12, wherein each of said pixels comprises a conductive pad, a first transistor coupled to said conductive pad, and a second transistor and capacitor coupled to a gate of said first transistor.

19. The display of claim 12, wherein said voltage applied to said ML sustains a Townsend Discharge of said noble gas.

20. The display of claim 14, wherein said ML is disposed in stripes.

21. A display comprising:

a first transparent substrate comprising:

a plurality of pixel elements arrange in a matrix, each pixel element comprising:

a conductive pad; and a phosphor material deposited on a corresponding conductive pad;

a TFT circuit coupled to a corresponding one of the conductive pad:

a passivating layer deposited between the pixel elements wherein at least the phosphor layer is exposed through the passivating layer; and a conductive frame deposited on the passivating layer between the pixel elements, wherein nanomaterial is deposited on the conductive frame;

a second substrate, positioned opposite to the first substrate, wherein the first and second substrates are sealed along their edges to form a cavity therebetween, the cavity being filled with a noble gas, the second substrate comprising:

a metal layer corresponding to one of said addressable pixels; and a nanomaterial deposited on the metal layer:

a control unit controlling at least one voltage source, to cause said at least one voltage source to:

selectively apply a voltage to each of the pixel elements, conductive frame and metal layer, wherein the voltage applied to the ML layer being negative with respect to the voltage applied to a corresponding one of the pixel elements a predetermined time after a voltage difference between the voltage applied to the conductive frame and the voltage applied to a corresponding one of the pixel elements exceeds a threshold voltage, said predetermined time being determined based on a time to ionize said noble gas.

* * * * *